US007577228B2

(12) United States Patent
Jackson

(10) Patent No.: US 7,577,228 B2
(45) Date of Patent: Aug. 18, 2009

(54) TRANSPORTABLE MANUFACTURING FACILITY FOR RADIOACTIVE MATERIALS

(75) Inventor: Mark Alan Jackson, Menomonee Falls, WI (US)

(73) Assignee: General Electric Company, Schenectady, NY (US)

( * ) Notice: Subject to any disclaimer, the term of this patent is extended or adjusted under 35 U.S.C. 154(b) by 935 days.

(21) Appl. No.: 10/687,826

(22) Filed: Oct. 20, 2003

(65) Prior Publication Data

US 2004/0086437 A1 May 6, 2004

Related U.S. Application Data

(60) Provisional application No. 60/429,325, filed on Nov. 27, 2002, provisional application No. 60/421,564, filed on Oct. 28, 2002.

(51) Int. Cl.
*G21G 1/00* (2006.01)
*G21G 4/08* (2006.01)

(52) U.S. Cl. ..... 376/190; 376/196; 376/198; 378/198; 422/903

(58) Field of Classification Search ..... 588/1, 588/252, 260; 600/436, 425, 407; 376/198, 376/190, 196; 250/363.04, 369, 506.1, 455.11; 378/198; 52/143; 313/62; 422/903; 976/DIG. 401
See application file for complete search history.

(56) References Cited

U.S. PATENT DOCUMENTS 3,411,002 A * 11/1968 Armel ..... 378/69
4,428,908 A * 1/1984 Ashley et al. ..... 422/61
4,943,781 A * 7/1990 Wilson et al. ..... 315/502
5,037,602 A * 8/1991 Dabiri et al. ..... 376/198
5,210,421 A 5/1993 Gullberg et al.
5,871,013 A 2/1999 Wainer et al.
5,927,351 A * 7/1999 Zhu et al. ..... 141/330
5,932,878 A 8/1999 Heukensfeldt et al.
6,162,417 A * 12/2000 Goodman et al. ..... 424/1.85
6,392,246 B1 * 5/2002 Wiberg et al. ..... 250/506.1
6,437,344 B1 * 8/2002 Strawson ..... 250/455.11
6,445,146 B1 * 9/2002 Bergstrom et al. ..... 315/502

(Continued)

OTHER PUBLICATIONS

K. Hamacher, H.H. Coenen and G. Stocklin, J. Nucl. Med., 1986, 27, 235.*

(Continued)

*Primary Examiner*—Wayne Langel
*Assistant Examiner*—Brittany M Martinez
(74) *Attorney, Agent, or Firm*—Hunton & Williams LLP

(57) ABSTRACT

The invention relates to a manufacturing facility comprising a building structure which encloses working space of the manufacturing facility, the building structure being designed to house a cyclotron and to be transportable by truck or rail to a destination site, wherein the manufacturing facility, except for lacking a cyclotron during transport, is substantially equipped during transport to produce and package a radiopharmaceutical. The invention also relates to a method of providing a manufacturing facility for producing a radioactive material, the method comprising the steps of designing the manufacturing facility to receive a cyclotron; equipping the manufacturing facility with a synthesis unit which is designed to receive a first radioactive material from the cyclotron and to produce a second radioactive material; transporting the manufacturing facility to a site; transporting the cyclotron to the site; and enclosing the cyclotron inside the manufacturing facility. The manufacturing facility may be relocated to another site without substantial effort.

24 Claims, 4 Drawing Sheets

U.S. PATENT DOCUMENTS 6,481,887 B1 11/2002 Mirabella

OTHER PUBLICATIONS

K. Hamacher, H.H. Coenen, and G. Stocklin, "Efficient Stereospecific Synthesis of No-Carrier-Added 2-[$^{18}$F]-Fluoro-2-Deoxy-D-Glucose Using Aminopolyether Supported Nucleophilic Substitution," 27 J. Nucl. Med., 235-238 (1986).

C. Lemaire et al., "Synthesis of [$^{18}$F]FDG with Alkaline Hydrolysis on a Low Polarity Solid Phase Support," 40 J. Labelled Compd. Radiopharm. 256 (1997).

C. Mosdzianowski et al., "Routine and Multi-Curie Level Productions of [$^{18}$F]FDG using an Alkaline Hydrolysis on Solid Support," 42 J. Labelled Cpd. Radiopharm. 515 (1999).

Patent Cooperation Treaty (PCT) International Search Report, PCT/US/03/33721, Apr. 23, 2004.

* cited by examiner

TRANSPORTABLE MANUFACTURING FACILITY FOR RADIOACTIVE MATERIALS

This application claims priority to U.S. Provisional Application No. 60/429,325, filed Nov. 27, 2002 and U.S. Provisional Application No. 60/421,564, filed Oct. 28, 2002.

FIELD OF THE INVENTION

The present invention relates generally to a manufacturing facility and more particularly to a transportable manufacturing facility for radioactive materials such as radiopharmaceuticals.

BACKGROUND OF THE INVENTION

Medical imaging is used extensively to diagnose and treat patients. A number of modalities are well known, such as Magnetic Resonance Imaging (MRI), Computed Tomography (CT), Positron Emission Tomography (PET), and Single Photon Emission Computed Tomography (SPECT). These modalities provide complementary diagnostic information. For example, PET and SPECT scans illustrate functional aspects of the organ or region being examined and allow metabolic measurements, but delineate the body structure relatively poorly. On the other hand, CT and MRI images provide excellent structural information about the body, but provide little functional information.

PET and SPECT are classified as "nuclear medicine" because they measure the emission of a radioactive material which has been injected into a patient. After the radioactive material, e.g., a radiopharmaceutical, is injected, it is absorbed by the blood or a particular organ of interest. The patient is then moved into the PET or SPECT detector which measures the emission of the radiopharmaceutical and creates an image from the characteristics of the detected emission.

A significant step in conducting a PET or SPECT scan is the step of acquiring the radiopharmaceutical. Examples of radiopharmaceuticals include FDG (2-[$^{18}$F]-fluoro-2-deoxyglucose), $^{13}$N ammonia, $^{11}$C carbon, $^{15}$O gas, and $^{15}$O water.

The half lives of these radiopharmaceuticals range from two minutes to two hours. Thus, the injection into the patient and the imaging must take place within a very short time period after production of the radiopharmaceutical. Hospitals without the facilities to manufacture radiopharmaceuticals must order them to be delivered by ground or air transport from nearby manufacturing facilities, which can be very expensive.

In response to the growing practice of using nuclear medicine imaging, such as PET, many hospitals have built their own radiopharmaceutical manufacturing facilities. This option is also typically very expensive; however, due to certain requirements of the facility, such as the structure required to support the massive cyclotron, the air circulation system for the facility which cannot return air into the hospital space, and the shielding requirements arising from the radioactive nature of the radiopharmaceutical. Some hospitals have built separate structures to house radiopharmaceutical production. However, this option, while generally easier to achieve than converting existing hospital space, still requires extensive planning to satisfy all the structural, functional, legal, and regulatory requirements placed on radiopharmaceutical manufacturing facilities.

Accordingly, there is a need for a cost effective method for producing radioactive materials such as radiopharmaceuticals which may be implemented easily by organizations requiring them, such as hospitals and medical imaging practices.

SUMMARY OF THE INVENTION

The invention, according to one embodiment, relates to a method of providing a manufacturing facility for producing a radioactive material, the method comprising the steps of designing the manufacturing facility to receive a cyclotron, equipping the manufacturing facility with a synthesis unit which is designed to receive a first radioactive material from the cyclotron and to produce a second radioactive material, transporting the manufacturing facility to a site, transporting the cyclotron to the site, and enclosing the cyclotron inside the manufacturing facility.

The invention, according to another embodiment, relates to a manufacturing facility comprising a building structure which encloses working space of the manufacturing facility, the building structure being designed to house a cyclotron and to be transportable by truck or rail to a destination site, wherein the manufacturing facility, except for lacking a cyclotron during transport, is substantially equipped during transport to produce and package a radiopharmaceutical. The manufacturing facility may be relocated to another site without substantial effort.

DETAILED DESCRIPTION OF THE INVENTION

Figure 1:
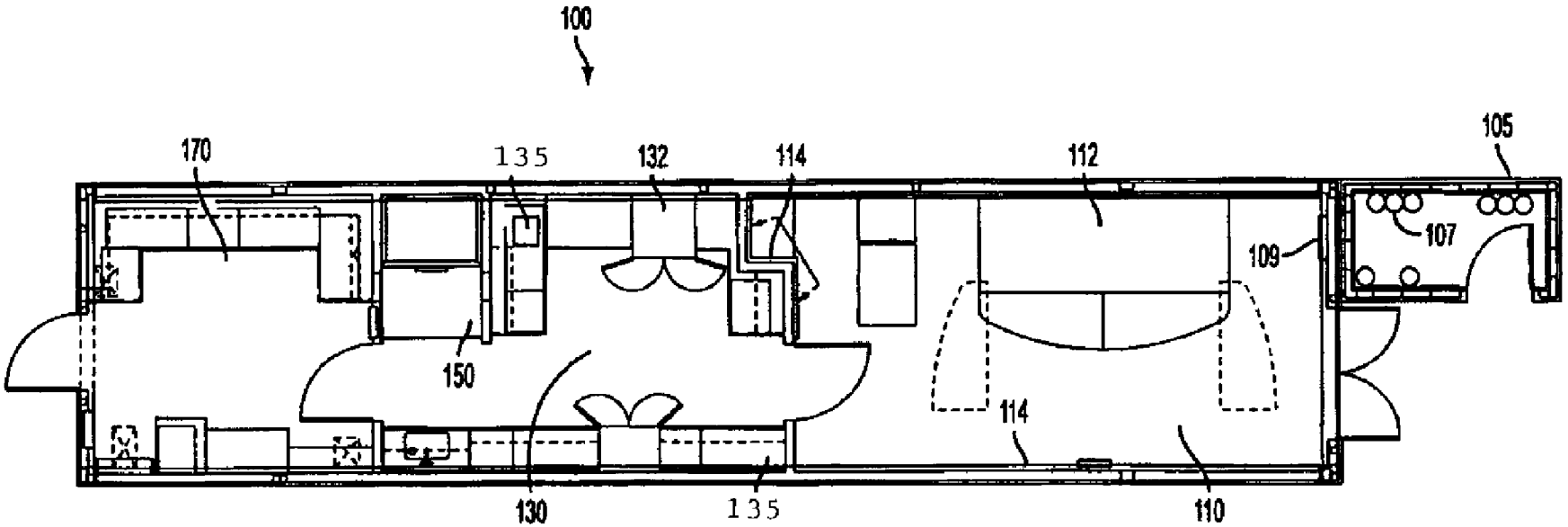
FIG. 1 is a diagram of a manufacturing facility according to an exemplary embodiment of the invention.

The invention relates to a manufacturing facility which includes one or more components used for producing a radioactive material which may be used, for example, in medical imaging. As shown in FIG. 1, one embodiment of the manufacturing facility 100 includes a cyclotron room 110 housing a cyclotron 112, a laboratory room 130 housing a synthesis unit 132 for converting a radioisotope into a radiopharmaceutical, a clean room 150 for dispensing the radioactive product into one or more containers, and a packaging room 170 for packaging the radioactive product for safe transport, e.g., to a medical imaging unit in a hospital.

The manufacturing facility 100 is designed to be transportable. For example, according to one embodiment, the outer dimensions of the manufacturing facility 100 are approximately 14 feet by 60 feet (4.27 meters by 18.29 meters), which allows the manufacturing facility 100 to be shipped by truck or rail to its destination. The manufacturing facility may be equipped prior to shipment with equipment for producing, processing, and packaging a radioisotope or radiopharmaceutical, with the exception of the cyclotron 112 which is typically shipped separately due to its large mass. The manufacturing facility 100 can be installed at a desired site by executing a small number of steps. According to one embodiment, a concrete slab for supporting the manufacturing facility 100 is poured at the desired site, the manufacturing facility is shipped to the site and placed on the slab, the cyclotron 112 is shipped to the site, placed in the manufacturing facility 100 and enclosed within the manufacturing facility, and utilities, including a power source, are connected to the manufacturing facility 100.

The manufacturing facility 100 may also be equipped with a communications port allowing communication over a network between a remote user and equipment within the manufacturing facility 100. For example, a remote user may conduct remote monitoring and diagnostics of the equipment by communicating with one or more computers 135 within the manufacturing facility 100 and/or with one or more sensors located on the equipment within the manufacturing facility 100.

The cyclotron 112, as is well known in the art, includes a cylindrical chamber placed between the poles of a large electromagnet which accelerates charged particles, e.g., hydrogen ions or deuterium ions. Air is pumped from the chamber to create a vacuum. Hydrogen or deuterium ions are fed into the center of the chamber by an ion source. Inside the chamber are two hollow electrodes which are connected to a radiofrequency (RF) high voltage source.

When the cyclotron 112 is in operation, the electric charge on the electrodes is reversed rapidly by the high frequency voltage source. The combination of the alternating high voltage and the action of the field of the electromagnet causes the hydrogen or deuterium ions inside to follow a spiral course as they acquire more kinetic energy.

When the hydrogen or deuterium ions reach the outer rim of the chamber, they are transformed to protons or deutrons and then deflected toward one or more targets, which are typically in the form of a liquid or gas. As the targets are hit by the beam of high energy particles, the target liquid or gas is transformed into a short half life radioactive substance. In the field of PET, the radioactive substance emits positrons and is commonly referred to as a PET tracer. One common example of a PET tracer is $^{18}F^-$. Other examples include $^{13}N$, $^{11}C$, and $^{15}O$. $^{13}N$ ammonia can be used in blood flow studies of the heart. $^{15}O$ water may be used in blood flow studies of the heart and brain. $^{11}C$ carbon may be labeled onto many types of biological compounds and used as a tracer to follow the compound though the body or individual metabolic pathway.

The cyclotron 112 can be oriented vertically, i.e., the plane of the spiral path of the particles is vertical. The vertical orientation reduces the cross sectional area of the cyclotron on the floor of the manufacturing facility 100, which allows the size, e.g., the width, of the manufacturing facility to be reduced, thus facilitating transportability. An example of a vertically oriented cyclotron which is suitable for use in conjunction with various embodiments of the present invention is the MIINITRACE cyclotron available from GE Medical Systems. The GE MINITRACE cyclotron can be installed in a structure having a relatively narrow width, e.g., 14 feet. Other types of cyclotrons may be used, e.g., horizontally oriented cyclotrons.

The cyclotron may be housed in its own self shielding housing which includes lead or other shielding for protecting users from exposure to radiation such as gamma rays and neutrons. For example, the GE MINITRACE cyclotron is typically housed in a structure which includes a lead, concrete, and boronated plastic shield. The manufacturing facility 100 can be designed to accommodate such a cyclotron which includes its own shield. In addition, the manufacturing facility 100 may include a radioactive shield of its own. For example, as shown in FIG. 1, the walls of the cyclotron room 110 may be equipped prior to transport with a shield 114, e.g., a 2-inch lead shield, which further protects users from radiation. Alternatively, the shielding provided with the cyclotron 112 may be sufficient, such that the walls of the manufacturing facility 100 are not shielded.

According to another embodiment, the manufacturing facility 100 is shipped with spaces in the walls of the cyclotron room 110 for receiving shielding members at the site. For example, concrete or lead slabs or panels may be shipped to the site and inserted into the spaces in the walls of the cyclotron room 110. This embodiment reduces the weight of the manufacturing facility 100 in transport without adding any significant complexity to the installation process.

The manufacturing facility 100 may include a storage area 105 for housing gases or other materials to be used by equipment in the manufacturing facility 100 such as the cyclotron 112. As shown in FIG. 1, the storage area 105 houses a number of cylinders 107 which may contain helium, hydrogen, and nitrogen, for example. A gas regulator panel 109 may be provided to regulate the flow of gases into the manufacturing facility 100.

Figure 2:
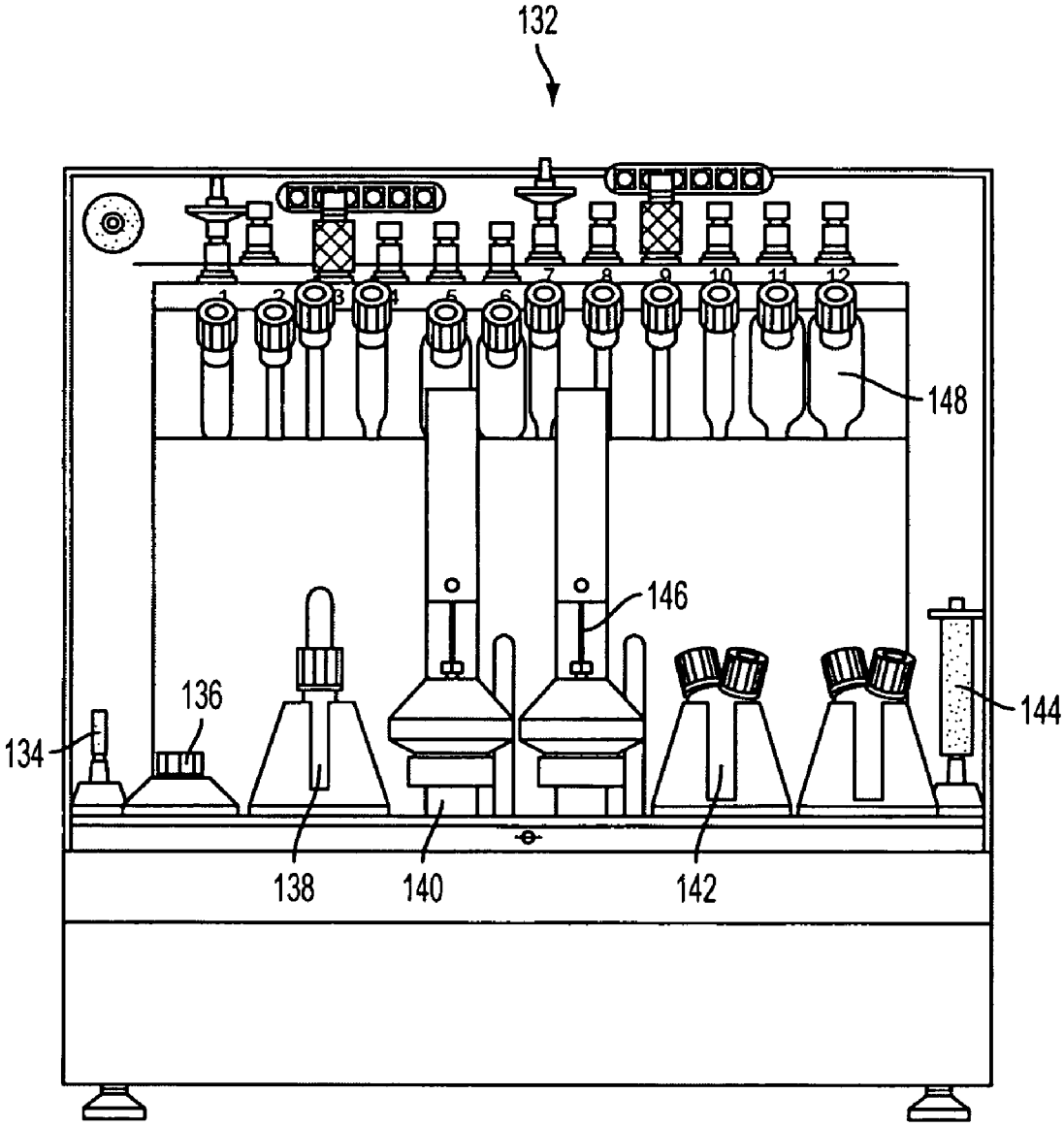
FIG. 2 is a drawing of a synthesis unit in the manufacturing facility according to an exemplary embodiment of the invention.

In many applications, the radioisotope produced by the cyclotron 112 is subjected to further processing before being administered to a patient. For example, $^{18}F$ is commonly convened to $^{18}FDG$ (2-[$^{18}F$]-fluoro-2-deoxyglucose), a radiopharmaceutical administered to patients undergoing PET imaging. To provide this capability, the manufacturing facility may be equipped with a synthesis unit 132, as shown in FIGS. 1 and 2. Prior to synthesis, the radioisotope produced by the cyclotron, e.g., $^{18}F$—, is transferred, e.g., automatically, to a reservoir on the synthesis unit 132.

The synthesis of FDG is based on separation of $^{18}F$ from [$^{18}O$]$H_2O$ using an anion exchange column and production of $^{18}FDG$ by nucleophilic substitution. In nucleophilic substitution, protective groups are removed from the FDG by basic hydrolysis. Step 1 in the synthesis process involves separation of [$^{18}F$]$F^-$ from [$^{18}O$]$H_2O$. The [$^{18}F$]$F^-$ is separated from the remaining [$^{18}O$]$H_2O$ using an anion exchange column. The $^{18}F^-$ ions are adsorbed on the ion exchange resin while the passing [$^{18}O$]$H_2O$ water is collected in a vial.

Step 2 of the process involves preparation of the nucleophilic substitution. The solution is evaporated and dried quantitatively so that no water is left. Drying may be executed by azeotropic distillation of the water with acetonitrile. The distillation may be followed by evaporation under vacuum.

Figure 4:
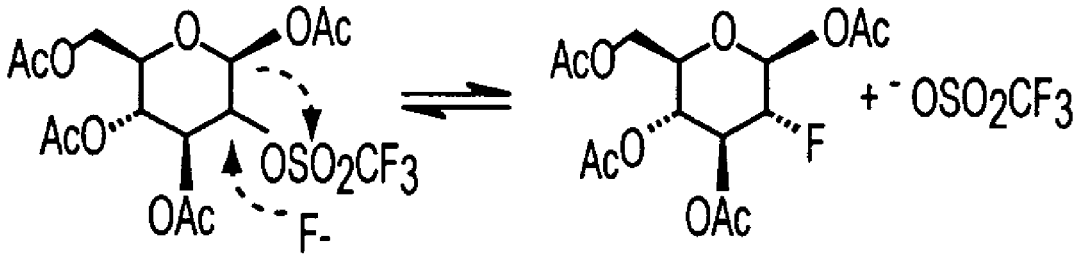
FIG. 4 is a diagram of a nucleophilic substitution reaction according to an exemplary embodiment of the invention.

Step 3 is nucleophilic substitution. In this step the FDG-precursor 1,3,4,6-tetra-O-acetyl-2-O-trifluoromethanesulphonyl-b-D-mannopyranose (dissolved in acetonitrile) is added to the reaction vessel. The triflate anion (trifloromethanesuiphonate) in C2-position is substituted under the presence of a transfer catalyst, such as the KRYPTOFIX 222® catalyst, by $F^-$. The reaction, shown in FIG. 4, takes place under 85° C. for 5 min.

After complete substitution, the toxic acetonitrile is removed quantitatively. The solvent is removed by distillation flowed by evaporation under vacuum.

Step 4 is a hydrolysis step, in which sodium hydroxide or hydrochloric acid is applied to remove all protective groups from the reaction product 2[$^{18}F$]fluoro-1,3,4,6-tetra-O-acetyl-D-Glucose.

Step 5 is a chromatographic purification step. To separate the 2-[$^{18}F$]FDG from organic by-products, $Na^+$-anions, KRYPTOFIX 222® catalyst, and remaining [$^{18}F$]$F^-$ anions after hydrolysis the solution, diluted with sterile water, is pushed through a purification column. The FDG is formulated as an isotonic solution of NaCl.

Additional details of this well known process are described in a number of publications, including K. Hamacher, H. H. Coenen and G. Stocklin, J. Nucl. Med. 27, 235-238 (1986); C. Lemaire et al., "Synthesis of [$^{18}F$]FDG with Alkaline Hydrolysis on a Low Polarity Solid Phase Support," 40 J. Labelled Compd. Radiopharm. 256 (1997); and C. Mosdzianowski et al., "Routine and Multi-Curie Level Productions of [$^{18}$F]FDG using an Alkaline Hydrolysis on Solid Support," 42 J. Labelled Cpd. Radiopharm. 515 (1999).

The synthesis process may be controlled by a computer 135 and displayed graphically on a screen along with relevant conditions and values. The components of the synthesis unit 132, e.g., valves, heaters, coolers, etc., can be controlled automatically or manually. Automated synthesis units are commercially available. One example is the TRACERLAB $Fx_{FDG}$ synthesis unit available from GE Medical Systems. Another example is the TRACERLAB MX FDG synthesis unit available from GE Medical Systems. Synthesis units are available commercially for producing other radiopharmaceuticals, such as the TRACERLAB $FX_{FDOPA}$ synthesis unit for producing F-labeled dopamine, the TRACERLAB $FX_N$ synthesis unit for producing various types of nucleophilic substitution produced compounds, the TRACERLAB $FX_E$ synthesis unit for producing various types of electrophilic substitution produced compounds, and the TRACERLAB $FX_C$ synthesis unit for producing various types of $^{11}$C labeled compounds.

Figure 3:
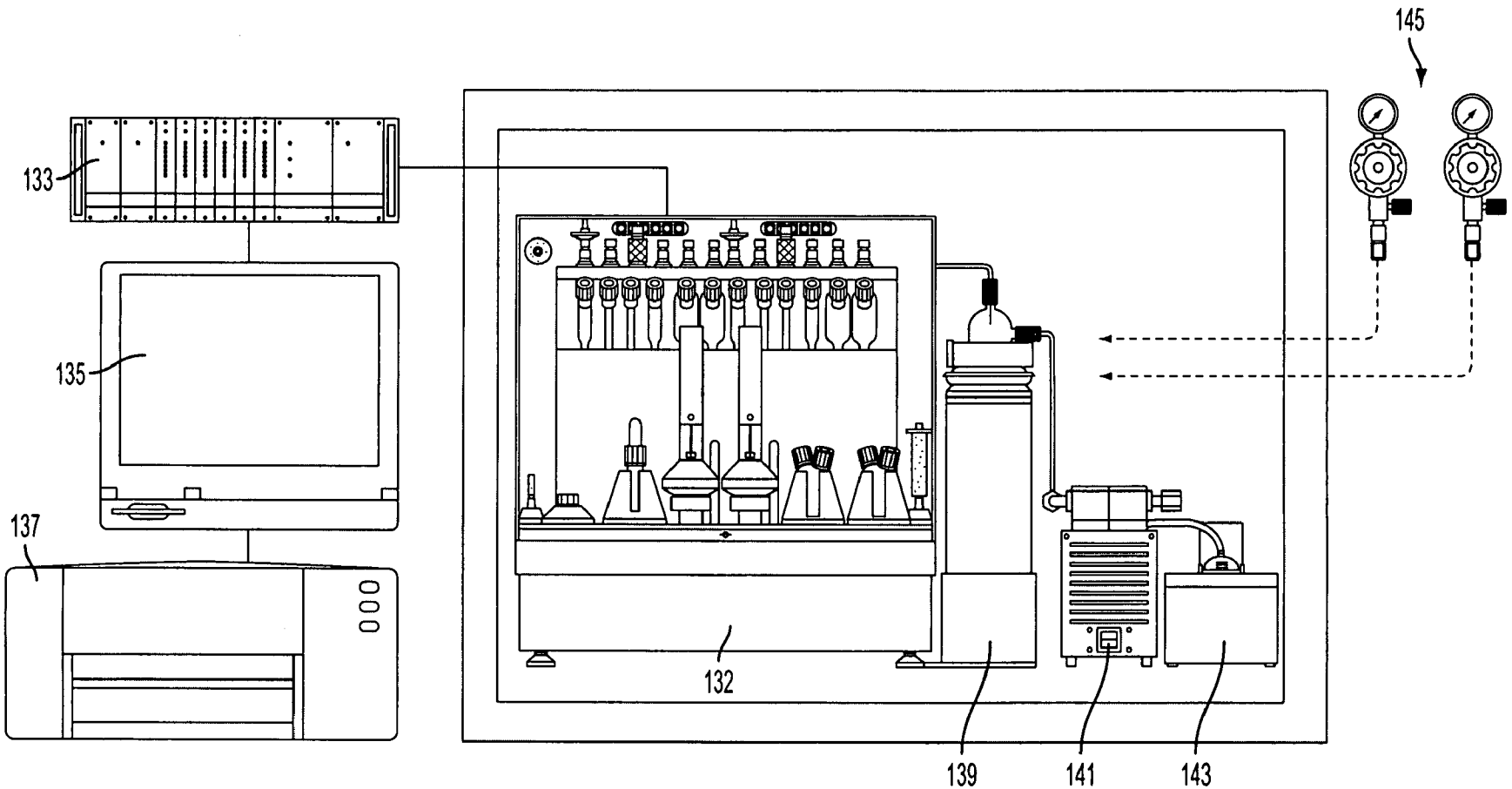
FIG. 3 is a drawing of the synthesis unit of FIG. 2 along with supporting apparatus according to an exemplary embodiment of the invention.

FIG. 2 shows an example of a synthesis unit 132 which may be used to manufacture the radiopharmaceutical $^{18}$FDG. The synthesis unit 132 includes an $^{18}$F separation cartridge 134, a target water vial 136, an $H_2{}^{18}O$ vial 138, a reactor 140, an FDG collection vessel 142, an FDG purification column 144, a reactor needle 146, and a reagent vial 148. FIG. 3 shows the synthesis unit 132 along with supporting apparatuses, including an electronics unit 133, a computer 135, a printer 137, a dewar 139, a vacuum pump 141, a transformer 143, and inert gas and compressed air regulators 145.

The collection vessel 142 of the synthesis unit 132 collects the radiopharmaceutical produced by the synthesis unit 132. The radiopharmaceutical solution can then be dispensed into a sterile vial, which may be sealed with a septum and cap.

The manufacturing facility 100 may include quality control equipment to measure the quality of the products produced in the facility. For example, GM-tubes may be provided to monitor the activity amounts of the target water of the cyclotron 112, the reactor vessel 140 of the synthesis unit 132, and the radiopharmaceutical collecting vial 142. High performance liquid chromatography equipment with a radioactive detector (Radio-HPLC) or radio-thin layer chromatography equipment (Radio-TLC) can be provided to measure the radiochemistry purity. High performance liquid chromatography (HPLC) equipment and gas chromatography (GC) equipment can be provided to analyze the chemical purity of the products. The products may also be tested for bacterial pyrogens according to conventional methods and transferred into biological media and incubated for a desired period, e.g., 14 days, to test for sterility.

The radiopharmaceutical produced by the synthesis unit 132 may be further processed for specific applications, e.g., fluoro L-thymidine, and dispensed into individual vials, for example in the clean room 150. Robotic systems such as those available from GE Medical Systems may be used to dispense the radiopharmaceutical into individual vials. The vials are then placed into a shielded container, e.g., constructed of lead or tungsten, which is transported to the desired location, e.g., a PET imaging center. The shipping container may be tested for both surface radiation and activity measured at a specified distance, e.g., one meter, from the container. Other testing may be required in certain states to meet state shipping regulations. State and federal regulations on pharmaceuticals and shipping typically require specific documentation of pharmaceutical shipments.

To facilitate proper handling and disposal of the radioactive materials, the manufacturing facility 100 typically includes a packaging room 170, in which a worker can label the vials and keep accurate records of production and delivery of the radiopharmaceuticals produced in the manufacturing facility 100. The inclusion of a packaging room 170 in the manufacturing facility provides the advantage that accurate records of radiopharmaceutical production and delivery can be made prior to delivery without relying on a separate office in a separate building.

Although not shown specifically in FIG. 1, the manufacturing facility 100 typically includes other equipment useful for producing radiopharmaceuticals. For example, the manufacturing facility 100 typically includes a "hot cell" which provides a radioactive shield and a vented environment for one or more synthesis units 132 and/or dispensing robots. A TLC scanner may be provided to determine the radio-chemical purity of the final radiopharmaceutical. A multichannel analyzer may be provided to determine the energy level of gamma rays, which allows a user to validate that only a PET isotope was generated by the cyclotron. A dose calibrator, which is typically an FDA licensed device, may be provided to determine the quantity of radioactivity in the dose being dispensed. Radiopharmaceuticals may be checked with a dose calibrator before being dispensed to the patient. An incubator may be provided to validate the sterility of the final product and to perform microbial testing of the manufacturing environment and air systems. An oven may be provided to depyrogenate glassware and other items used in the production of the radiopharmaceutical. A complete radiation monitoring system can assure production workers of an acceptable level of background radiation in all areas of the facility. Additional monitoring of all gases and air exhaust systems can be maintained providing a continuous recording of all radioactivity that is released into the environment.

The manufacturing facility 100 shown in FIG. 1 can be constructed in an efficient manner, which allows a hospital or other user to acquire the capability of producing radiopharmaceuticals with minimal effort in a short time period. According to one embodiment, a foundation, such as a concrete slab, is constructed, e.g., poured, at the site as an initial step in installing the manufacturing facility 100. A connection to a power supply, water supply, and communication link may also be installed at the site.

The manufacturing facility 100 is then delivered to the site, e.g., by truck or rail, with substantially all of the production equipment included, except typically for the cyclotron 112. The cyclotron is usually delivered separately due to its excessive weight. At the site, the manufacturing facility 100 is unloaded onto the foundation and connected to the power supply. The cyclotron 112 is then inserted into the manufacturing facility 100 to complete the installation process. The installation process, from the time of delivery of the manufacturing facility 100 at the site to the time at which radioisotope production begins, can usually be completed in 14 days, for example.

In some circumstances, where the site is located adjacent to public areas, additional shielding may be required. In such case, the walls of the cyclotron room 110 in the manufacturing facility 100 may include a lead or concrete shield. The lead or concrete shield may be installed prior to shipment of the manufacturing facility 100. Alternatively, the manufacturing facility 100 may be shipped with spaces or cavities in the walls of the cyclotron room 110 for insertion of the lead or concrete shield at the site. In that case, the lead or concrete shield may take the form of panels which are inserted into the spaces in the walls of the cyclotron room 110 at the site.

Various laws and regulations and Current Good Manufacturing Practices (CGMP) govern the production and use of radioactive materials. These laws and regulations may vary from state to state. The manufacturing facility 100 can be constructed to satisfy all such laws and regulations so that a customer, wherever located, does not have to address any issues involved in achieving compliance with such laws and regulations.

Because the manufacturing facility 100 is transportable, it is possible to remove it from the site. The ability to remove the manufacturing facility may provide commercial advantages to both the buyer and the seller based on the residual value of the manufacturing facility. For example, the buyer can resell the manufacturing facility. The seller can repossess the manufacturing facility if the buyer defaults in payment. The manufacturing facility can also be leased as opposed to sold, which may provide additional flexibility to the lessor and lessee.

To further facilitate transactions for supplying a manufacturing facility 100, the provider, e.g., seller or lessor, may offer financing or installation services. The provider may also configure the manufacturing facility 100 to include a communications connection, so that the provider can offer remote monitoring and diagnostics services with respect to the equipment in the manufacturing facility. For example, the provider may monitor the state of the equipment to determine when planned or unplanned maintenance should be performed and offer to provide maintenance services for the manufacturing facility to the customer.

While the foregoing description includes details and specificities, it is to be understood that these have been included for purposes of explanation only, and are not to be interpreted as limitations of the present invention. Modifications to the embodiments described above can be made without departing from the spirit and scope of the invention, which is intended to be encompassed by the following claims and their legal equivalents.

What is claimed is:

1. A method of providing a manufacturing facility for producing a radioactive material, the method comprising:

designing the manufacturing facility;

transporting the manufacturing facility to a site;

transporting a cyclotron to the site; and enclosing the cyclotron inside the manufacturing facility.

2. The method of claim 1, further comprising the step of equipping the manufacturing facility with a laboratory room and a synthesis unit located in the laboratory room which is designed to receive a first radioactive material from the cyclotron and to produce a second radioactive material.

3. The method of claim 2, wherein the first radioactive material is a radioisotope and the second radioactive material is a radiopharmaceutical.

4. The method of claim 2, wherein the synthesis unit receives $^{18}$F— from the cyclotron and produces 2-[$^{18}$F]-fluoro-2-deoxyglucose.

5. The method of claim 2, wherein the second radioactive material is adapted for use in a Positron Emission Tomography scanner or a Single Photon Emission Computed Tomography scanner.

6. The method of claim 2, further comprising the step of equipping the manufacturing facility with a packaging room to label one or more vials containing the second radioactive material prior to transporting the manufacturing facility to the site.

7. The method of claim 1, further comprising the step of equipping the manufacturing facility with radiation shielding prior to transporting the manufacturing facility to shield radiation produced by the cyclotron.

8. The method of claim 1, further comprising the step of installing radiation shielding in walls of the manufacturing facility after the manufacturing facility has been transported to the site.

9. The method of claim 6, further comprising the step of equipping the manufacturing facility with quality control equipment to measure a quality of the second radioactive material prior to transporting the manufacturing facility to the site.

10. The method of claim 9, further comprising the step of equipping the manufacturing facility with radiopharmaceutical packaging equipment prior to transporting the manufacturing facility to the site.

11. The method of claim 1, further comprising the step of equipping the manufacturing facility with a communications port for remote monitoring the manufacturing facility prior to transporting the manufacturing facility to the site, the communications port being connected to at least one sensor on the cyclotron.

12. The method of claim 3, wherein the manufacturing facility is designed to satisfy all legal and regulatory requirements of the jurisdiction in which the site is located.

13. The method of claim 2, further comprising the step of equipping the manufacturing facility with a clean room for dispensing the second radioactive material into one or more containers prior to transporting the manufacturing facility to the site.

14. A method comprising the steps of:

receiving a manufacturing facility at a site, the manufacturing facility being substantially equipped for producing a radioactive material, except that the manufacturing facility lacks a cyclotron;

receiving a cyclotron at the site;

enclosing the cyclotron within the manufacturing facility; and allowing the cyclotron to be removed from the manufacturing facility.

15. The method of claim 14, further comprising the step of allowing the manufacturing facility to be removed from the site.

16. The method of claim 14, further comprising the step of reselling at least one of the cyclotron and the manufacturing facility.

17. The method of claim 14, wherein the manufacturing facility, except for lacking a cyclotron during transport, is substantially equipped during transport to produce and package a radiopharmaceutical.

18. The method of claim 17, wherein the manufacturing facility is designed to satisfy all legal and regulatory requirements of the jurisdiction in which the site is located.

19. The method of claim 17, wherein the manufacturing facility is designed to satisfy all legal and regulatory requirements of the state and federal governments of the United States.

20. A method of providing a manufacturing facility for producing a radiopharmaceutical, the method comprising:

designing the manufacturing facility to receive a cyclotron;

equipping the manufacturing facility with a synthesis unit and a packaging area, wherein the packaging area allows labeling of containers containing the radiopharmaceutical and entering of records of production and delivery of the pharmaceutical;

transporting the manufacturing facility to a site;

transporting the cyclotron to the site; and enclosing the cyclotron inside the manufacturing facility, wherein the manufacturing facility is designed to satisfy substantially all legal and regulatory requirements of the jurisdiction in which the site is located.

21. The method of claim 20, further comprising the step of equipping the manufacturing facility with a laboratory room to receive the synthesis unit which is designed to receive a first radioactive material from the cyclotron and to produce the radiopharmaceutical.

22. The method of claim 20, further comprising the step of equipping the manufacturing facility with quality control equipment to measure a quality of the radiopharmaceutical prior to transporting the manufacturing facility to the site.

23. The method of claim 20, further comprising the step of equipping the manufacturing facility with radiopharmaceutical packaging equipment prior to transporting the manufacturing facility to the site.

24. The method of claim 20, further comprising the step of equipping the manufacturing facility with a clean room for dispensing the radiopharmaceutical into one or more containers prior to transporting the manufacturing facility to the site.

* * * * *

UNITED STATES PATENT AND TRADEMARK OFFICE

CERTIFICATE OF CORRECTION

PATENT NO. : 7,577,228 B2
APPLICATION NO. : 10/687826
DATED : August 18, 2009
INVENTOR(S) : Mark Alan Jackson It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1270 days.

Signed and Sealed this

Seventh Day of September, 2010

David J. Kappos

David J. Kappos
*Director of the United States Patent and Trademark Office*